United States Patent [19]

Andersen et al.

[11] 4,262,935

[45] Apr. 21, 1981

[54] DONOR MATERIAL FOR CARBONLESS COPYING AND COATING COMPOSITION FOR THE SAME

[75] Inventors: John V. Andersen, Vaerlose, Denmark; Guido Dessauer, Duesseldorf-Gerresheim, Fed. Rep. of Germany

[73] Assignees: Feldmuhle Aktiengesellschaft, Dusseldorf, Fed. Rep. of Germany; Aktieselskabet For Kontor Kemi, Glostrup, Denmark

[21] Appl. No.: 952,269

[22] Filed: Oct. 18, 1978

[30] Foreign Application Priority Data

Oct. 26, 1977 [DE] Fed. Rep. of Germany ..... 2747899
Jan. 18, 1978 [DK] Denmark ..... 249/78

[51] Int. Cl.[3] ..... B41L 1/20

[52] U.S. Cl. ..... 282/27.5; 428/220; 428/240; 428/323; 428/340; 428/486; 428/488; 428/914

[58] Field of Search ..... 427/150, 151; 428/914, 428/340, 240, 220, 323, 486, 488; 282/27.5; 106/21, 22, 28, 31, 32

[56] References Cited

U.S. PATENT DOCUMENTS

| | | | |
|---|---|---|---|
| 2,743,191 | 4/1956 | Klimkowski et al. | 427/150 |
| 3,823,022 | 7/1974 | Thomas | 427/151 |
| 3,824,118 | 7/1974 | Tsuboi et al. | 427/151 |
| 3,894,168 | 7/1975 | Brockett et al. | 427/150 |
| 3,957,495 | 5/1976 | Teranishi et al. | 427/150 |
| 3,995,088 | 11/1976 | Garner | 427/151 |

*Primary Examiner*—Ronald H. Smith
*Assistant Examiner*—Janyce A. Bell
*Attorney, Agent, or Firm*—Toren, McGeady and Stanger

[57] ABSTRACT

A donor material for carbonless copying by contact with an acceptor material under applied pressure includes a sheet of paper or the like, and a coating on one face of the sheet. The coating consists essentially of a dye precursor, a wax solid at 20° C. and capable of dissolving the precursor, and a liquid activator soluble in the molten wax, but at most sparingly soluble in the solid wax and incapable of dissolving the dye precursor, the wax and activator being chemically inert to the dye precursor.

15 Claims, No Drawings

DONOR MATERIAL FOR CARBONLESS COPYING AND COATING COMPOSITION FOR THE SAME

This invention relates to carbonless copying in which a colored image is produced under the pressure of a writing implement by reaction of a dye precursor as an electron donor with an electron acceptor such as an acid clay, and more particularly to a coating composition for a donor material and to the application of the coating composition.

It is known to coat one sheet of paper with a composition containing a dye precursor and to superimpose the coated sheet, hereinafter referred to as a donor sheet, on another sheet coated with or otherwise provided with an electron acceptor. When the coating is suitably formulated, pressure applied to the set of donor and acceptor sheet causes transfer of dye precursor to the acceptor sheet and the formation of a colored image on the acceptor sheet. Unless reaction between the dye precursor and the acceptor in the absence of relatively high pressure is prevented, the contrast between the desired image and its background is reduced by fogging, that is, by random dye formation.

The problem is well known, and was solved in the best practice available heretofore by encapsulating a solution of the dye precursor in an oily liquid and to coat the donor sheet with a composition in which a multitude of minute capsules (microcapsules) are embedded. When the capsules are carefully constructed and other measures are taken for their protection, they are not broken to release their contents unless adequate pressure is applied. The donor sheets coated with encapsulated dye precursors are relatively expensive to manufacture. They also do not make full use of the dye precursor in that not all capsules are fractured under writing pressure. Yet, such donor sheets have replaced earlier sheets in which the dye precursors were uniformly distributed in a continuous film.

Gelatine was proposed as a frangible film material in German Pat. No. 831,704, relying on the priority of a U.S. application filed July 31, 1948. The use of wax films melting at 35°-50° C. was disclosed in German published application No. 1,511,277 in which the priority of the French application No. 31432 of Sept. 15, 1965, was claimed. The low melting point was brought about by the admixture of plasticizers commonly employed for polyvinyl chloride which are good solvents for the dye precursors.

The earlier gelatine films lack adequate mechanical strength. It is an inherent shortcoming of the plasticizers in the last-mentioned wax films that they tend to migrate from the donor sheet coating into the acceptor sheet surface together with dissolved dye precursor so that the storage life of sets of donor and acceptor sheets is limited.

The use of waxes as carriers for the dye precursor of the donor material is also mentioned in German Pat. No. 2,556,083 which claims the priority of the Austrian application No. A 1405, filed Feb. 25, 1975. Various combinations of waxes with plasticizers and other adjuvants are disclosed, but their effect on fogging is not discussed.

A donor coating prepared according to German published application No. 2,048,846, which relies on the priority of U.S. application Ser. No. 867,397, filed Oct. 17, 1969, consists mainly of polymer particles in which the dye precursor is insoluble. The polymer particles are loosely bonded to each other by thermal welds and carry the dye precursor particles on their surfaces. Transfer of the coated carrier particles is facilitated by the presence of a silicone oil in which the dye precursor is insoluble so that an unintentional transfer of dye material to the acceptor sheet by means of the liquid is avoided. The reaction between the solid dye precursor particles and acceptor materials is relatively slow, and good contrast between the dye image and the acceptor sheet is difficult to achieve.

It is the object of the invention to provide a donor sheet which may be assembled with an acceptor sheet in a durable copying set not subject to fogging, and yet capable of producing a well-defined, colored image under the pressure of a writing implement such as the key of a typewriter.

At the core of this invention is a coating composition for a donor sheet which consists essentially of one or more dye precursors capable of reacting with an electron acceptor to form a colored dye, a wax solid at 20° C. and capable of dissolving the precursor or precursors, and a liquid, organic activator soluble in the molten wax, but insoluble, or at most sparingly soluble in the wax at 20° C. The activator must be present in the composition in a first phase separate from a second phase which includes the wax and dye precursor or precursors, the latter being insoluble in the activator. The wax and activator must be inert to the dye precursor or precursors.

The chemical nature of the waxes and activators in the coating compositions of the invention is immaterial if the condition of inertness is met. The term "wax", as employed in this specification and the appended claims, is therefore to be interpreted broadly, as defined by Hackh's Chemical Dictionary (McGraw-Hill Book Company, New York, 1969) to encompass substances characterized by a crystalline to microcrystalline structure, the capacity of acquiring gloss when rubbed, the capacity to produce pastes or gels with suitable solvents when mixed with other waxes, and a low solubility in solvents for fats at room temperature. A wax for the purpose of this invention thus may be a material of mineral, vegetal, or animal origin, a synthetic derivative of such a material, or a compound or mixture of compounds produced entirely by synthesis. However, from the vast number of known waxes, relatively few meet the requirement of dissolving dye precursors, and of dissolving the compounds or compound mixtures, referred to as "activators" for lack of a recognized generic term, above the melting point of the wax, but of dissolving very little if any activator when the wax is solid, as at 20° C.

"Activators", for the purpose of this invention, are normally liquid organic compounds or mixtures of compounds whose chemical nature is immaterial as long as they do not react with the dye precursors and cannot dissolve the same. Because of their limited solubility in the solid wax phase which also includes the dye precursor, they form a separate phase in the coating composition.

Numerous dye-precursors and suitable electron acceptors causing formation of a colored dye in contact with the precursors are known, and those enumerated in the afore-mentioned patents and patent applications are merely illustrative of the state of this rapidly developing art. Others will be mentioned hereinbelow. A dye precursor or a mixture of dye precursors may be chosen quite freely to achieve desired properties of the colored image, such as color, rate of color development, durability of the colored image under light or during prolonged storage at elevated temperature, and the like. The choice of a specific dye precursor limits the choice of waxes and activators, and only specific combinations of waxes and activators exhibit the necessary low solubility or insolubility of the activator in the wax.

Suitable waxes include, but are not limited to, ozokerite and ceresin obtained by purification of ozokerite, microcrystalline paraffin waxes, ester waxes derived from montan wax by oxidation of the natural product and esterification of the long-chain carboxylic acids so produced, carnauba wax, amide waxes produced by reaction of fatty acids with ammonia and amines, chlorinated paraffin waxes having a chlorine content high enough to make them solid at 20° C., m-terphenyl wax derived from aromatic hydrocarbons, petrolatum wax, and polyvinyl octadecyl ether wax.

Carnauba wax, amide waxes, and microcrystalline paraffin waxes have advantageous dissolving characteristics for crystal violet lactone. p-Toluenesulfonate of Michler's hydrol (PTSMH), another known dye precursor, dissolves with particular ease in ester waxes and microcrystalline paraffin waxes. Amide waxes are the preferred solvents for benzoylleukomethylene blue.

Some liquid activators may tend to migrate from the donor coating into a coating on the acceptor sheet. While fogging cannot be caused by such migration, the activator present as a separate liquid phase between crystallites of wax including the dye precursor controls the ease with which the wax particles are released from the substrate of the donor sheet. The amount of activator present in the coating composition should therefore not be allowed to decrease unduly. Certain waxes, such as the microcrystalline paraffin waxes, petrolatum wax, ozokerite, and branched-chain paraffin waxes partly constituting ozokerite are known to retain adsorbed oils more readily than others, and show a similar action on the activators of this invention. Ozokerite is particularly effective in this respect.

Excluded from use in the coating compositions of this invention are waxes which can react chemically with dye precursors or specific dye precursors, such as waxes having a relatively high acid number. Stearic acid, which is a wax under the definition cited above, is thus unsuited. Equally unsuited are waxes which are not solvents for any presently known dye precursors, such as polyethylene waxes and pure unbranched paraffin waxes.

It is generally preferred to employ as a wax a mixture of different compounds or materials. Some desirable properties are possessed only by relatively costly waxes, but are not significantly impaired by dilution with inexpensive waxes if the mixture still meets the solubility criteria set forth above. Some otherwise desirable waxes have melting ranges which make the coating process difficult. Admixture of another wax may modify the melting range of the coating composition.

An activator combining low cost with the necessary solubility characteristics is paraffinic mineral oil. It is used to advantage with crystal violet lactone and PTSMH which are entirely insoluble in paraffinic mineral oil. The viscosity of the mineral oil affects the processing characteristics of the coating composition relatively little, and mineral oils which are liquid at an ambient temperature of 20° C. are generally useful.

Dibutyl phthalate, having no relevant similarity in chemical structure with mineral oil, is a good activator in coating compositions containing crystal violet lactone. It dissolves PTSMH and is thus not permissible in coating compositions containing the last-mentioned dye precursor.

Ethyleneglycol and polyethyleneglycol are other activators compatible with many dye precursors. While other grades are useful at least to some extent, liquid polyethyleneglycols are generally preferred.

Castor oil and olive oil are representative of good activators of vegetable origin, and neats-foot-oil may constitute a major portion of an activator mixture containing other ingredients which lower the melting point of the mixture to less than that of pure neats-foot-oil. Such fixed vegetal and animal oils are unsuited if their acid number is so high as to cause reaction with the dye precursor.

The ratio between the essential components of the coating composition may vary between relatively wide limits. Generally, the amount of activator should be smaller than the amount of wax, and most coating compositions of the invention employed successfully so far contain 35% to 85% activator and 2% to 15% dye precursor based on the weight of the wax. Inert, pulverulent fillers may be present in the composition for making the coating opaque or for affecting the processing characteristics of the coating composition. Calcium carbonate, starch, urea-formaldehyde resin and talcum are representative of such fillers and may be present in amounts of 20% to 80%, based on the weight of the wax. The inorganic fillers are generally preferred.

Coating compositions of the invention are prepared by intimately mixing the ingredients above the melting point of the wax. When the homogeneous solution of activator and dye precursor in the molten wax is cooled, the wax crystallizes, the dye precursor remains in solid solution in the wax phase, but at least a major portion of the activator accumulates as a thin, substantially continuous layer at the boundaries of the wax crystallites, thereby reducing the cohesive strength of the coating and permitting individual wax crystallites bearing the dissolved dye precursors to be transferred from the substrate of the donor sheet, such as paper, to the acceptor sheet.

The wax melt may be deposited on the substrate by known melt coating techniques employed, for example, in the manufacture of carbon paper, or the melt may be dispersed in water, and the dispersion deposited on the substrate and dried. The composition should normally amount to 2 to 12 grams per square meter of coated substrate surface, corresponding to a coating thickness of 2 to 20 $\mu$m. A coating of 4–6 g/m$^2$ is adequate under many conditions.

The coating compositions of the invention are employed to advantage wherever coatings of encapsulated dye precursors were used heretofore. Donor sheets of the invention may thus be coated on one face and assembled in a set with an acceptor sheet. A donor sheet including a thin substrate may be interleaved between uncoated paper and an acceptor sheet in the manner of carbon paper for producing on the acceptor sheet an copy of an image being drawn, written, or printed on the uncoated paper. Coating compositions of the invention may be deposited on the backs of papers whose front faces carry acceptor coatings. When the donor compositions of the invention are deposited on acceptor sheets in which the acceptor material is distributed throughout the thickness of the sheet, a blocking coating impervious to the wax and the dye precursor even under pressure is preferably interposed between the donor coating and the substrate. The sheets combining donor and acceptor properties are assembled in sets with each other and with uncoated papers.

The following Examples are further illustrative of the coating compositions of the invention and of donor sheet material for carbonless copying coated with such compositions. "Parts" and percent values in the Examples are by weight unless specifically stated otherwise.

EXAMPLE 1

26 Parts carnauba wax were molten, and 4 parts crystal violet lactone were dissolved in the melt at 85° C. with vigorous stirring. A mixture prepared from 25 parts ozokerite, 30 parts paraffinic mineral oil (4.5° E. at 50° C.), and 15 parts calcium carbonate was added, and the resulting composition was ground on a colloid mill until the pigment was uniformly dispersed.

It was coated in the molten state at 90° C. on a base paper for making single-use carbon paper weighing 23 g/m$^2$ in an amount of 6 g/m$^2$, and the paper carrying the still fluid coating composition was passed over refrigerated cylinders to cool is quickly to approximately 10° C. The coating then consisted of two intimately mixed phases of very small particle size. An oily phase consisting mainly of mineral oil enveloped solid particles of the other phase which contained the carnauba wax, the ozokerite, and the dye precursor.

The coated paper was employed like single-use carbon paper between an uncoated top sheet and a bottom sheet coated with an acceptor composition in which Montmorillonite was the active component.

EXAMPLE 2

1 Part crystal violet lactone was dissolved at 90° C. in a wax melt prepared from 3.5 parts amide wax (Abril Wax 5, Abril Industrial Waxes Ltd., Great Britain) and 3 parts carnauba wax (No. 3 North Country). Separately, 2.5 parts fully refined paraffin wax melting at 60°–62° C., 2.5 parts ozokerite, 2 parts emulsifier (Abril Emulgator OWT), and 4.25 parts paraffinic mineral oil (4.5°E/50° C.) were mixed, and the mixture was added to the melt at 90° C. The composition was slowly added to enough water at 95° C. to make a dispersion of 35% solids, while the mixture was stirred vigorously.

The dispersion was permitted to cool to room temperature and was then coated on the back of paper sheets weighing 50 g/m$^2$ in an amount of 5 g/m$^2$ on an airdry basis. The coated sheets were assembled in alternating sets with coated acceptor sheets.

EXAMPLE 3

3 Parts p-toluene sulfonate of Michler's hydrol (hereinafter PTSMH) was dissolved at 85° C. in a melt of 32 parts microcrystalline paraffin wax (TexWax MH, Texaco Inc.) and 35 parts ester wax (Hoechst-Wax E, Farbwerke Hoechst, Germany) with vigorous agitation. 30 parts paraffinic mineral oil (4.5° E/50° C.), and the hot composition was coated on selected areas of a form printed on both sides of a sheet of paper. The initial imprint was clearly readable through the transparent coating which amounted to 7 g/m$^2$ coated surface. When the partly coated surface was superimposed on an acceptor sheet, and the form was filled in by means of a ball pen, selected portions of the ink insertions appeared on the acceptor sheet.

EXAMPLE 4

4 Parts crystal violet lactone was dissolved at 85° C. in a melt of 25 parts carnauba wax (No. 3 North Country), 12 parts TexWax MH 19, and 2 g parts ozokerite. Ultimately, 30 parts paraffinic mineral oil (4.5° E./50° C.) was added with vigorous agitation.

A special base paper suitable for hot coating, weighing 40 g/m$^2$ and normally employed for printing airplane tickets, was coated with the hot composition at a rate of 5 g/m$^2$. When the coated paper was superimposed on an acceptor paper including dispersed asbestos fibers as reactive agent, as disclosed in the copending, commonly owned application Ser. No. 760,275, filed Jan. 18, 1977, and now U.S. Pat. No. 4,131,710, a clear colored image formed on the acceptor sheet wherever pressure was applied to the uncoated side of the donor sheet.

EXAMPLE 5

20 Parts Kera wax 472 (Kerax Ltd., Great Britain), 20 parts paraffin (m.p. 60°–62° C.), 1 part amide wax were mixed and molten, and 1 part Pergasrriptrot I 6B (Ciba-Geigy: 3,3-bis(7-n-octyl-2'-methylindol-3'-yl) phthalide) was added to the melt with stirring until dissolved. The coating composition was completed by further adding 26 parts paraffinic mineral oil, 0.5 part triethanolamine monooleate (Emulan FM, BASF), 10.5 parts Calcium carbonate and 21 parts talcum. The composition was applied to paper as a donor material in a conventional manner.

EXAMPLE 6

30 Parts ester wax (O-wax of Farbwerke Hoechst), 10 parts paraffin wax (m.p. 57°–60° C.), 15 parts precipitated calcium carbonate (Socal N-4), 30 parts mineral oil (CS 125, British Petroleum) were combined as a uniform melt by stirring at approximately 110° C. In a separate container, a dye precursor concentrate was prepared from 10% ethyleneglycol, 30% mineral oil (CS 125 BP), 30% crystal violet lactone, and 30% amide wax (stearic amide). 15 Parts concentrate was dispersed in the melt which then was ready for use as a hot coating composition.

EXAMPLE 7

A wax melt was prepared from 30 parts ester wax (OP-Wax, BASF), 10 parts polyvinyloctadecyl ether wax (V-Wax, BASF), 20 parts Socal N-4, and 30 parts mineral oil (CS 125 BP). A dye precursor concentrate was prepared by mixing 10% blown castor oil, 30% mineral oil (CS 125 BP), 30% crystal violet lactone, and 30% stearic amide, and 10 parts concentrate were stirred into the wax melt.

EXAMPLE 8

A coating composition was prepared as in Example 1, but a mixture of dye precursors was used consisting of 1 part Benzoylleukomethylene blue and 4 parts cristal violet lactone. The coated donor paper so obtained did not differ from the product described with reference to Example 1, but the colored image produced by reaction of the dye precursor mixture with the clay differed in color in the expected manner.

EXAMPLE 9

The procedure described in Example 2 was modified in that the 1 part of crystal violet lactone was replaced by a uniform mixture of 1 part Pergascriptoliv IG (Ciba-Geigy: indolylcompound) and 0,20 part Pergascriptviolet IR (Ciba-Geigy: aminofluorancompound). The dispersion produced had coating characteristics and produced results not significantly different from those of the coating composition described in Example 2 except that the composition leads to a block colored image.

Paper is the preferred substrate for the coating compositions of this invention under most circumstances. However, the paper substrate does not participate in the reaction between the dye precursor and the acceptor and may be replaced by any other substrate chemically inert to the dye precursor, not necessarily in the form of a sheet or a continuous web. Polyester and polyethylene foils may be provided with coatings according to the invention in a conventional manner. If the formation of a mirror image is not objectionable, a coating composition of the invention may be deposited on a block of glass, marble, or metal, the coated face of an acceptor sheet placed on the block, and an image formed on the acceptor sheet by drawing lines or otherwise pressing on the uncoated back of the acceptor sheet.

It should be understood, therefore, that the foregoing disclosure relates only to preferred embodiments, and that it is intended to cover all changes and modifications of the examples herein chosen for the purpose of the disclosure which do not constitute departures from the spirit and scope of the invention set forth in the appended claims.

What is claimed is:

1. A donor sheet for carbonless copying consisting essentially of a substrate of sheet material and of a solid coating on one face of said substrate, said coating consisting essentially of at least one dye precursor capable of reacting with an electron acceptor to form a colored dye, a wax, solid at 20° C. and capable of dissolving said precursor when in the molten condition, and an activator soluble in the molten wax, but at most sparingly soluble in said wax at 20° C., said activator being present in said composition in a first phase separate from a second phase including said wax and said precursor, said precursor being insoluble in said activator, said wax and said activator being chemically inert to said precursor, said coating consisting essentially of solid particles of said second phase, each particle being surrounded by a thin, substantially continuous layer of said first phase.

2. The donor sheet of claim 1 wherein said activator consists of at least one member of the group consisting of mineral oil, fixed oils of vegetable and animal organisms, dibutyl phthalate, ethyleneglycol and liquid polyethyleneglycol.

3. The donor sheet of claim 1 or 2 wherein said wax consists predominantly of at least one member of the group consisting of microcrystalline paraffin wax, carnauba wax, ester wax, amide wax, m-terphenyl wax, polyvinyl octadecyl ether wax, and chlorinated paraffin wax.

4. The donor sheet of claim 3 wherein said wax further includes at least one member of the group consisting of paraffin having a branched chain, ozokerite, and petrolatum wax.

5. The donor sheet of claim 1 further comprising at least one pulverulent filler inert to said precursor.

6. The donor sheet of claim 5 wherein said at least one filler is a member of the group consisting of calcium carbonate, urea formaldehyde resin, starch, and talcum.

7. The donor sheet of claim 1 wherein said at least one dye precursor is crystal violet lactone.

8. The donor sheet of claim 7 wherein the coating contains benzoylleukomethylene blue in an amount smaller than the amount of said crystal violet lactone.

9. The donor sheet of claim 7 or 8 wherein said activator consists of paraffinic mineral oil, and said wax is a first mixture of ozokerite and carnauba wax, or a second mixture of ester wax, paraffin wax, and amide wax, or a third mixture of ester wax, polyvinyl octadecyl ether wax, and amide wax.

10. The donor sheet of claim 1 wherein said at least one dye precursor consists predominantly of p-toluenesulfonate of Michler's hydrol, said wax is a mixture of microcrystalline paraffin and ester wax, and said activator is a paraffinic mineral oil.

11. The donor sheet of claim 1 wherein said activator amounts to 35% to 85% of the weight of said wax, and said dye precursor amounts to 2% to 15% of said weight.

12. The donor sheet of claim 11 further including an inert, pulverulent, inorganic filler an amount of 20% to 80% of the weight of said wax.

13. A donor sheet as set forth in claim 1, wherein said coating amounts to 2 to 12 grams per square meter of said one face.

14. A donor sheet as set forth in claim 1, wherein said sheet material is paper.

15. A set of carbonless copying material comprising a donor sheet as set forth in claim 1 and an acceptor sheet juxtaposed to said donor sheet, said acceptor sheet including said electron acceptor contiguously adjacent said coating in an amount sufficient for reacting with said dye precursor and producing a visible amount of said dye when a portion of said first phase is transferred to said acceptor sheet by pressure applied to said set.

* * * * *